US010041482B2

(12) United States Patent
Wei et al.

(10) Patent No.: US 10,041,482 B2
(45) Date of Patent: Aug. 7, 2018

(54) COMPRESSOR, AIR CONDITIONER SYSTEM COMPRISING THE COMPRESSOR AND HEAT PUMP WATER HEATER SYSTEM

(71) Applicant: NATIONAL ENGINEERING RESEARCH CENTER OF GREEN REFRIGERATION EQUIPMENT, Zhuhai, Guangdong (CN)

(72) Inventors: Huijun Wei, Guangdong (CN); Wantao Li, Guangdong (CN)

(73) Assignee: NATIONAL ENGINEERING RESEARCH CENTER OF GREEN REFRIGERATION EQUIPMENT (CN)

( * ) Notice: Subject to any disclaimer, the term of this patent is extended or adjusted under 35 U.S.C. 154(b) by 788 days.

(21) Appl. No.: 14/391,384

(22) PCT Filed: Dec. 7, 2012

(86) PCT No.: PCT/CN2012/086194
§ 371 (c)(1),
(2) Date: Oct. 8, 2014

(87) PCT Pub. No.: WO2013/152599
PCT Pub. Date: Oct. 17, 2013

(65) Prior Publication Data

US 2015/0078928 A1 Mar. 19, 2015

(30) Foreign Application Priority Data

Apr. 10, 2012 (CN) ..... 2012 1 0104581

(51) Int. Cl.
*F04C 23/00* (2006.01)
*F04B 1/12* (2006.01)
(Continued)

(52) U.S. Cl.
CPC ..... *F04B 1/12* (2013.01); *F04B 25/04* (2013.01); *F04C 18/356* (2013.01); *F04C 28/02* (2013.01);
(Continued)

(58) Field of Classification Search
CPC .. F04B 1/12; F04B 25/04; F04B 25/00; F04B 41/06; F04C 29/042; F04C 29/0035;
(Continued)

(56) References Cited

U.S. PATENT DOCUMENTS 5,322,424 A * 6/1994 Fujio ..... F04C 18/3564 418/11
2008/0267804 A1* 10/2008 Morozumi ..... F04C 18/3564 418/60
(Continued)

FOREIGN PATENT DOCUMENTS

CN 101835987 9/2010
CN 201963552 9/2011
(Continued)

OTHER PUBLICATIONS

International Search Report, PCT/CN2012/086194, dated Mar. 14, 2013.

*Primary Examiner* — Charles Freay
(74) *Attorney, Agent, or Firm* — Matthew A. Pequignot; Pequignot + Myers

(57) ABSTRACT

Provided is a compressor, an air conditioner system comprising the compressor and a heat pump water heater system. The compressor comprises: a low-pressure compression component, a medium-pressure chamber, a low-pressure chamber gas discharge passageway, an enthalpy-increasing component, a high-pressure compression component, a medium-pressure gas passageway and a high-pressure chamber gas discharge passageway. The medium-pressure
(Continued)

gas passageway comprises a passageway section at the side toward the low-pressure chamber gas discharge passageway and a passageway section at the side toward the high-pressure chamber gas suction passageway, wherein a ratio between a minimum cross sectional area of the passageway section at the side toward the low-pressure chamber gas discharge passageway and a minimum cross sectional area of the passageway section at the side toward the high-pressure chamber gas suction passageway is ranged from 1.4 to 4. In the compressor, the pressure fluctuation and the flow velocity fluctuation of the refrigerant are relatively smaller, which can improve the first-stage gas discharge plumpness and the second-stage gas suction plumpness, and increase the gas replenishment volume, thereby improving the working efficiency and the energy efficiency ratio of the compressor, and reducing the energy consumption.

18 Claims, 14 Drawing Sheets

(51) Int. Cl.

| | |
|---|---|
| ***F04C 28/02*** | (2006.01) |
| ***F04C 29/00*** | (2006.01) |
| ***F04C 18/356*** | (2006.01) |
| ***F04B 25/04*** | (2006.01) |
| ***F25B 29/00*** | (2006.01) |
| ***F25B 31/00*** | (2006.01) |
| ***F04C 29/04*** | (2006.01) |
| *F01C 21/10* | (2006.01) |

(52) U.S. Cl.
CPC ..... *F04C 29/0035* (2013.01); *F04C 29/042* (2013.01); *F25B 29/003* (2013.01); *F25B 31/00* (2013.01); *F01C 21/10* (2013.01); *F04C 23/001* (2013.01); *F04C 23/008* (2013.01)

(58) Field of Classification Search
CPC ..... F04C 29/00; F04C 29/023; F04C 29/024; F04C 18/356; F04C 18/3564; F04C 28/02; F04C 23/008; F04C 23/001; F04C 23/00; F04C 2250/102; F04C 29/065; F04C 29/068; F04C 18/322; F04C 27/009; F01C 21/0863; F01C 21/04; F25B 20/003; F25B 31/00; F25B 2400/13; F25B 2400/23; F04D 17/12; F04D 19/007; F04D 19/02; F04D 13/04; F02M 59/32
USPC ..... 418/60, 63, 11, 88, 94, 181
See application file for complete search history.

(56) References Cited

U.S. PATENT DOCUMENTS

| | | | | |
|---|---|---|---|---|
| 2008/0286118 | A1* | 11/2008 | Gu | F04C 18/0215 417/1 |
| 2009/0090118 | A1* | 4/2009 | Pham | F04B 39/06 62/228.5 |
| 2010/0278674 | A1* | 11/2010 | Byun | F04C 18/3564 418/60 |

FOREIGN PATENT DOCUMENTS

| | | |
|---|---|---|
| CN | 102374166 | 3/2012 |
| CN | 202560563 | 11/2012 |
| JP | 2000-54975 | 2/2000 |
| JP | 2006-177595 | 7/2006 |

* cited by examiner

COMPRESSOR, AIR CONDITIONER SYSTEM COMPRISING THE COMPRESSOR AND HEAT PUMP WATER HEATER SYSTEM

RELATED APPLICATION DATA

This application is the national stage entry of International Appl. No. PCT/CN2012/086194, filed Dec. 7, 2012, which claims priority to Chinese Patent Application No. CN 201210104581.4, filed Apr. 10, 2012. All claims of priority to these applications are hereby made, and each of these applications is hereby incorporated in its entirety by reference.

TECHNICAL FIELD

The present disclosure relates to the field of air conditioner and heat pump, more particularly, to a compressor, an air conditioner system comprising the compressor and a heat pump water heater system comprising the compressor.

BACKGROUND

In the prior art, after the two-staged enthalpy-increasing compressor with two rotors increases enthalpy through replenishing gas, the pressure and the flow velocity of the refrigerant in different sections of the medium-pressure gas passageway are different, whereas the cross sectional areas of different sections of the medium-pressure gas passageway are the same. Consequently, the flow velocity fluctuation between the gas discharge of the low-pressure compression component and the gas suction of the high-pressure compression component is greater, which will affect the discharge plumpness and the suction plumpness of the compressor, and accordingly, will reduce the working efficiency and the energy efficiency ratio of the compressor, and increase the energy consumption.

SUMMARY

The present disclosure aims at providing a compressor which can increase the working efficiency and the energy efficiency ratio of the compressor, and reduce the energy consumption. The present disclosure further provides an air conditioner system comprising the compressor, and a heat pump water heater system comprising the compressor.

The present disclosure provides a compressor, comprising: a low-pressure compression component having a low-pressure chamber, configured to take in refrigerant and compress the refrigerant to form first medium-pressure refrigerant; a medium-pressure chamber; a low-pressure chamber gas discharge passageway, through which the first medium-pressure refrigerant from said low-pressure compression component is discharged into the medium-pressure chamber; an enthalpy-increasing component, configured to convey second medium-pressure refrigerant into the medium-pressure chamber, the second medium-pressure refrigerant and the first medium-pressure refrigerant being mixed to form mixed medium-pressure refrigerant in the medium-pressure chamber; a high-pressure compression component including a high-pressure chamber, configured to take in the mixed medium-pressure refrigerant and compress the mixed medium-pressure refrigerant to form high-pressure refrigerant; a medium-pressure gas passageway, through which the mixed medium-pressure refrigerant from the medium-pressure chamber is conveyed into the high-pressure compression component; a high-pressure chamber gas discharge passageway, through which the high-pressure refrigerant is discharged from the high-pressure compression component; characterized in that, the medium-pressure gas passageway comprises a passageway section at the side toward the low-pressure chamber gas discharge passageway, and a passageway section at the side toward the high-pressure chamber gas suction passageway, wherein, a ratio between minimum cross sectional area of the passageway section at the side toward the low-pressure chamber gas discharge passageway and minimum cross sectional area of the passageway section at the side toward the high-pressure chamber gas suction passageway is ranged from 1.4 to 4.

Further, the medium-pressure gas passageway further comprises an intermediate passageway section, which is disposed between the passageway section at the side toward the low-pressure chamber gas discharge passageway and the passageway section at the side toward the high-pressure chamber gas suction passageway; wherein, a ratio $H_2$ between the minimum cross sectional area of the passageway section at the side toward the low-pressure chamber gas discharge passageway and a minimum cross sectional area of the intermediate passageway section is ranged from 1.2 to 2; a ratio $H_3$ between the minimum cross sectional area of the intermediate passageway section and the minimum cross sectional area of the passageway section at the side toward the high-pressure chamber gas suction passageway is ranged from 1.2 to 2.

Further, a ratio between cross sectional area of the low-pressure chamber gas discharge passageway and cross sectional area of the high-pressure chamber gas discharge passageway is 1.2.

Further, a ratio $H_1$ between the minimum cross sectional area $H_M$ of the medium-pressure gas passageway and minimum cross sectional area $H_L$ of the low-pressure chamber gas discharge passageway is greater than 1.2.

Further, a volume ratio $R_1$ between volume $V_H$ of the high-pressure chamber and volume $V_L$ of the low-pressure chamber is ranged from 0.8 to 0.9.

Further, the compressor further comprises a crankshaft; the crankshaft comprises a first eccentric part and a second eccentric part; the low-pressure compression component comprises a low-pressure cylinder, and a low-pressure roller which is disposed on the first eccentric part inside the low-pressure cylinder; the low-pressure chamber is formed between the low-pressure cylinder and the low-pressure roller; the high-pressure compression component comprises a high-pressure cylinder, and a high-pressure roller which is disposed on the second eccentric part inside the high-pressure cylinder; and the high-pressure chamber is formed between the high-pressure cylinder and the high-pressure roller.

Further, eccentricity amount of the first eccentric part is equal to eccentricity amount of the second eccentric part; and height of the high-pressure cylinder is less than height of the low-pressure cylinder.

Further, eccentricity amount of the first eccentric part is less than eccentricity amount of the second eccentric part; and height of the high-pressure cylinder is equal to height of the low-pressure cylinder.

Further, a ratio between height and inner diameter of the low-pressure cylinder is ranged from 0.4 to 0.55; a ratio between height and inner diameter of the high-pressure cylinder is ranged from 0.4 to 0.55; a ratio between eccentricity amount of the first eccentric part and the inner diameter of the low-pressure cylinder is ranged from 0.1 to 0.2; and a ratio between eccentricity amount of the second eccentric part and the inner diameter of the high-pressure cylinder is ranged from 0.1 to 0.2.

Further, a volume ratio $R_2$ between volume $V_M$ of the medium-pressure chamber and volume $V_L$ of the low-pressure chamber is greater than 1.

Further, the compressor further comprises: a lower flange, which is provided under the low-pressure compression component, and said lower flange is provided with a concave cavity at its lower part; a lower cover plate, which is provided under the lower flange, and said lower cover plate covers on the concave cavity of the lower flange so that the medium-pressure chamber is formed by the lower flange and the lower cover plate.

Further, the compressor further comprises: an intermediate cylinder, which is provided between the low-pressure compression component and the high-pressure compression component, and the intermediate cylinder is provided with a concave cavity at one side facing high-pressure compression component; a pump baffle plate, which is provided between the high-pressure compression component and the intermediate cylinder, and the pump baffle plate covers on the concave cavity of the intermediate cylinder so that the medium-pressure chamber is formed by the intermediate cylinder and the pump baffle plate.

Further, the compressor further comprises: a case component, configured to accommodate the low-pressure compression component and the high-pressure compression component; an intermediate box, which is provided at an exterior of the case component, and the intermediate box has an inner cavity which forms the medium-pressure chamber.

The present disclosure further provides an air conditioner system comprising the compressor described above.

The present disclosure further provides a heat pump water heater system comprising the compressor described above. In the compressor of the present disclosure, because of the reasonable design of the medium-pressure gas passageway and the optimal design for the range of the ratio between the minimum cross sectional area of the passageway section at the side toward the low-pressure chamber gas discharge passageway and the minimum cross sectional area of the passageway section at the side toward the high-pressure chamber gas suction passageway, the pressure fluctuation and the flow velocity fluctuation of the refrigerant are relatively smaller, which can improve the first-stage gas discharge plumpness and the second-stage gas suction plumpness, and increase the gas replenishment volume, thereby improving the working efficiency and the energy efficiency ratio of the compressor, and reducing the energy consumption.

BRIEF DESCRIPTION OF DRAWINGS

The figures, as a part of this disclosure, facilitate further understanding for the present disclosure. The illustrative embodiments and the corresponding descriptions are just for explaining the present disclosure, and they are not intended to restrict the present disclosure. In the figures.

DETAILED DESCRIPTION OF DISCLOSED EMBODIMENTS

Figure 1:
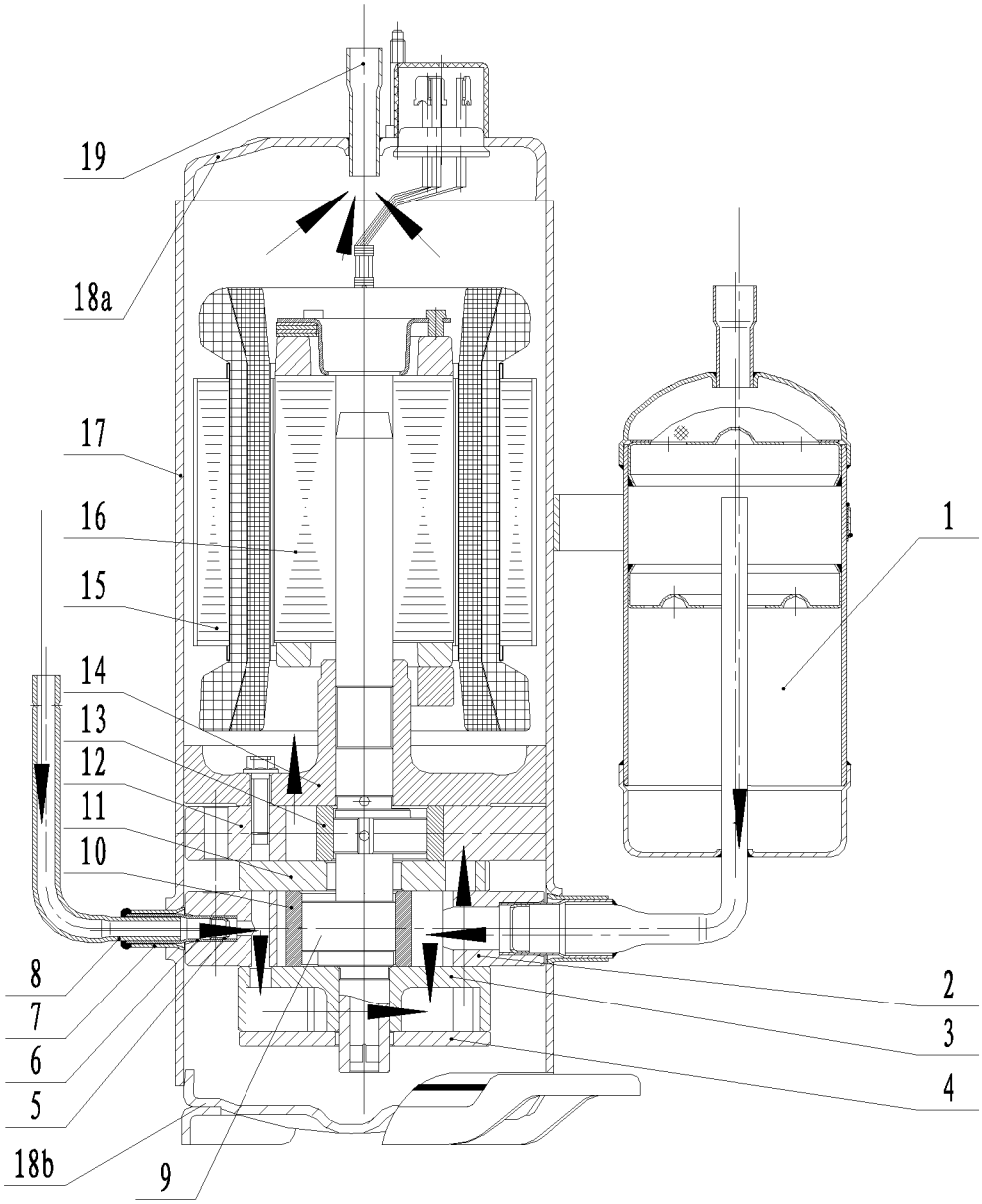
FIG. 1 is a schematic view illustrating the structure of the compressor according to the first embodiment of the present invention.
Figure 2:
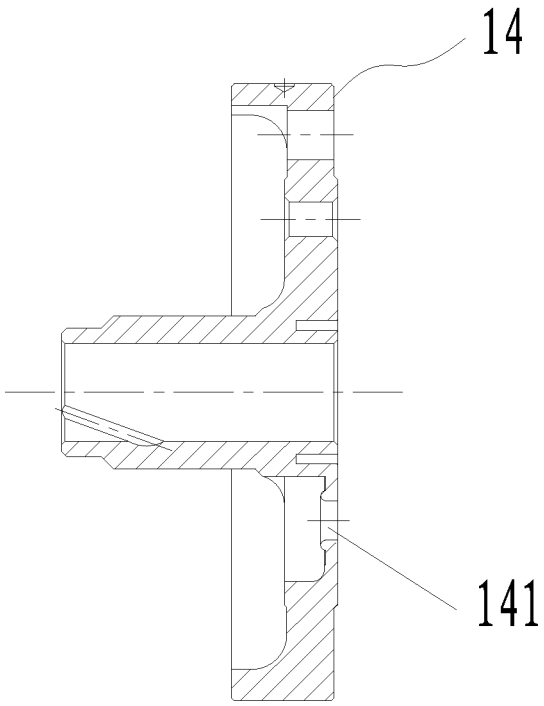
FIG. 2 is a sectional schematic view illustrating the upper flange of the compressor according to the first embodiment of the present invention.
Figure 3:
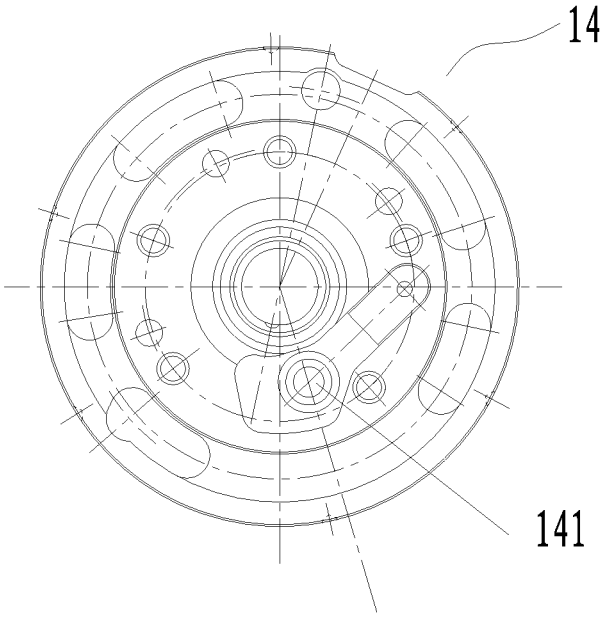
FIG. 3 is a left view of FIG. 2.
Figure 4:
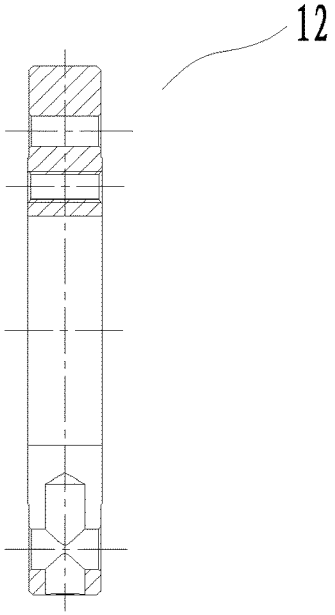
FIG. 4 is a sectional schematic view illustrating the high-pressure cylinder of the compressor according to the first embodiment of the present invention.
Figure 5:
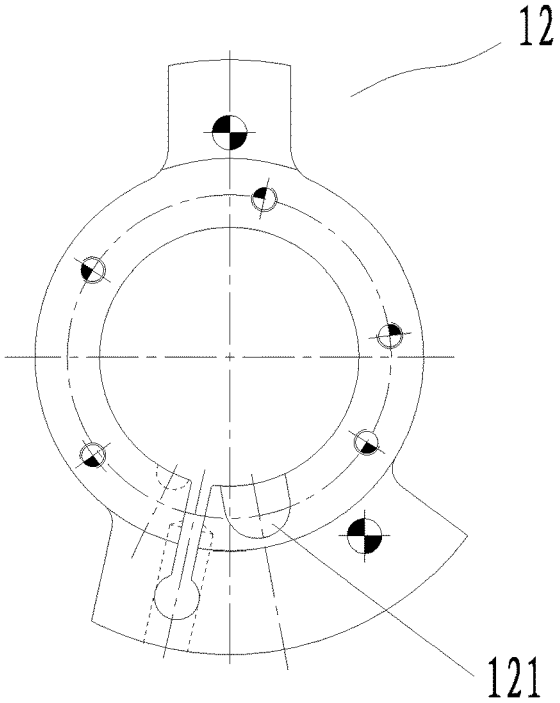
FIG. 5 is a right view of FIG. 4.
Figure 6:
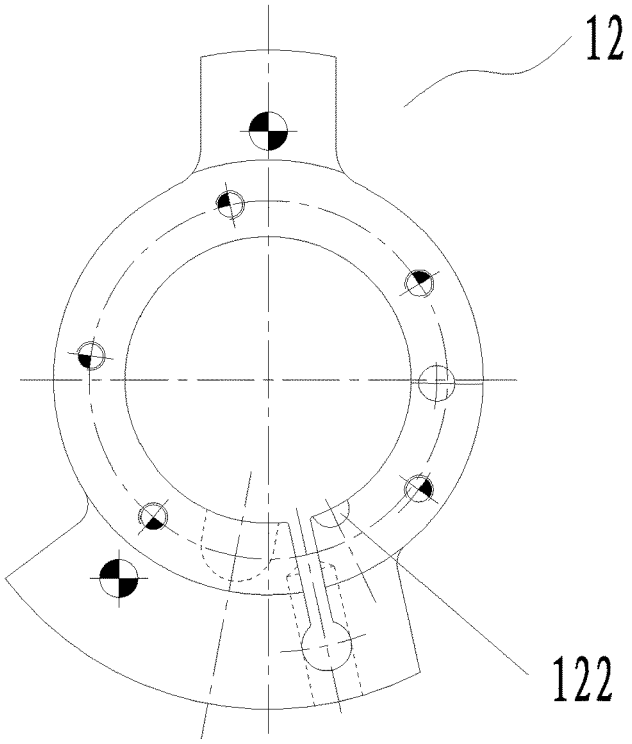
FIG. 6 is a left view of FIG. 4.
Figure 7:
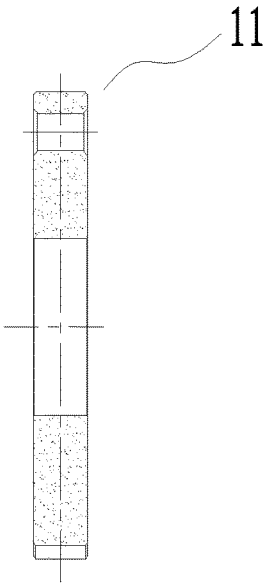
FIG. 7 is a sectional schematic view illustrating the pump baffle plate of the compressor according to the first embodiment of the present invention.
Figure 8:
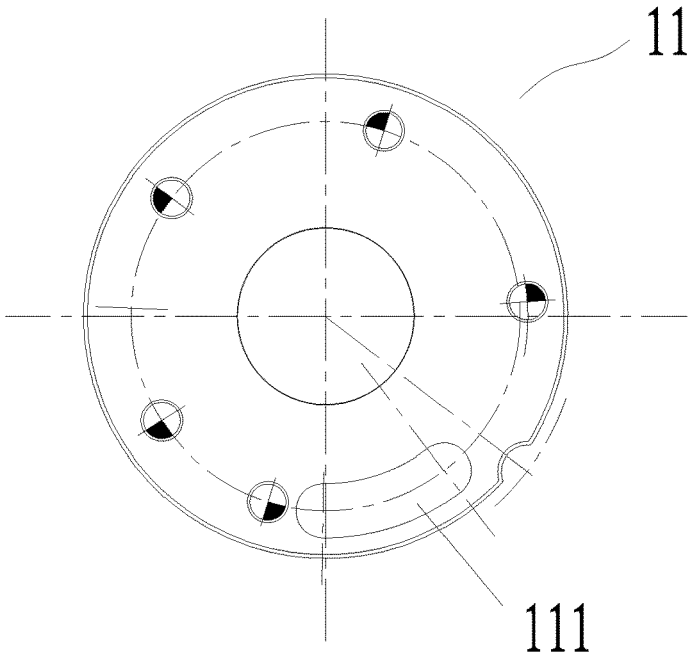
FIG. 8 is a left view of FIG. 7.
Figure 9:
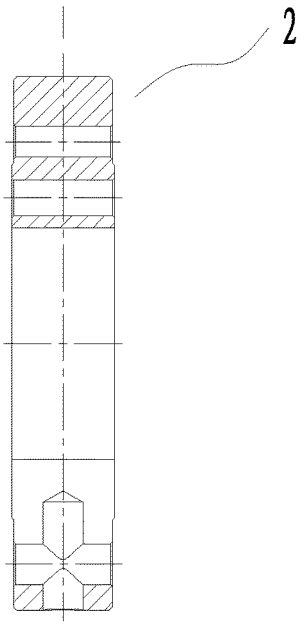
FIG. 9 is a sectional schematic view illustrating the low-pressure cylinder of the compressor according to the first embodiment of the present invention.
Figure 10:
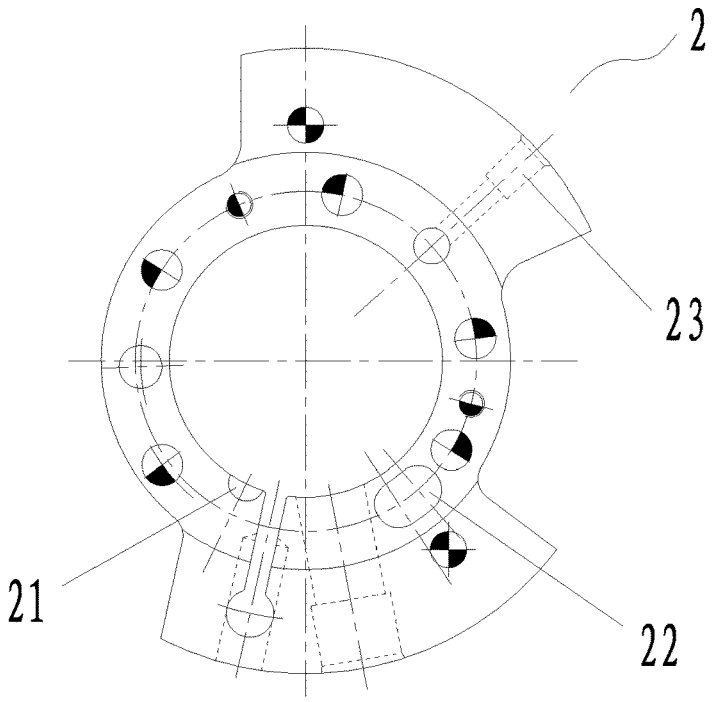
FIG. 10 is a right view of FIG. 9.
Figure 11:
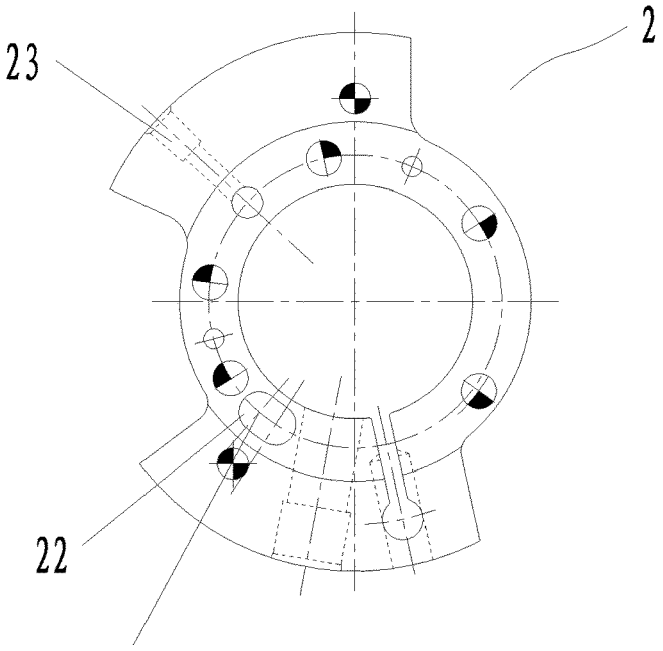
FIG. 11 is a left view of FIG. 9.
Figure 12:
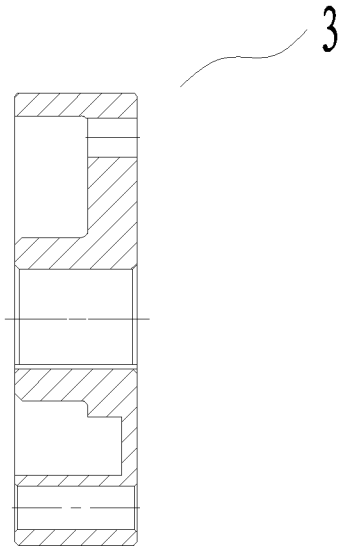
FIG. 12 is a sectional schematic view illustrating the lower flange of the compressor according to the first embodiment of the present invention.
Figure 13:
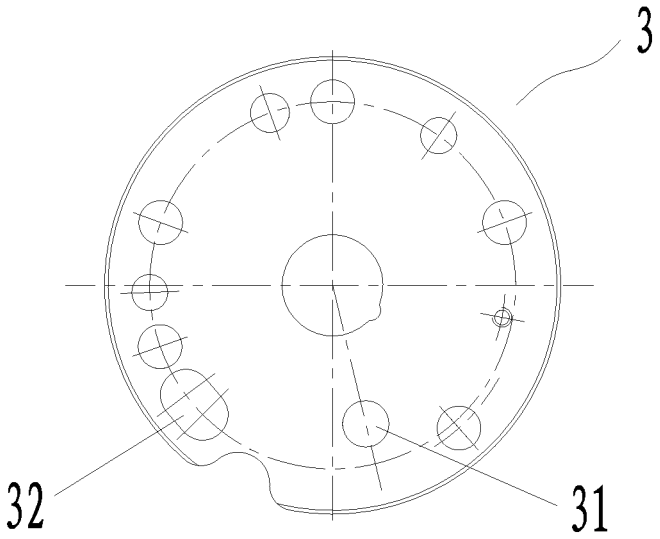
FIG. 13 is a right view of FIG. 12.
Figure 14:
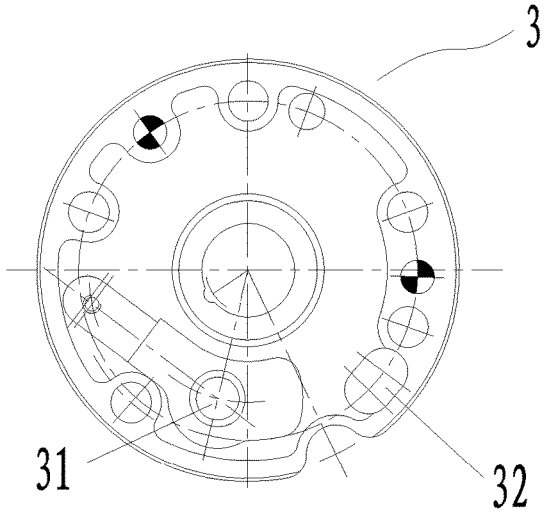
FIG. 14 is a left view of FIG. 12.
Figure 15:
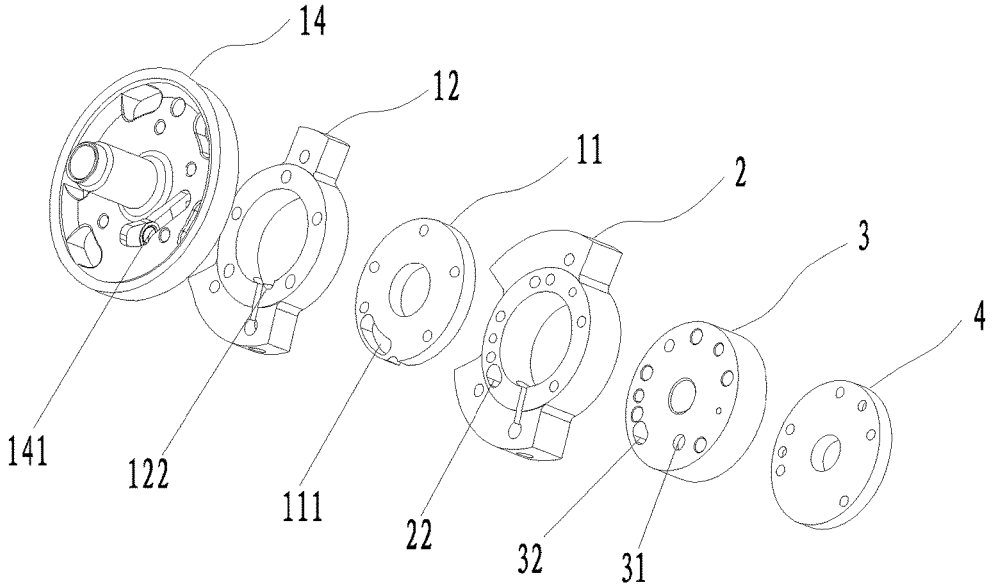
FIG. 15 is an exploded schematic view illustrating the low-pressure compression component and the high-pressure compression component of the compressor according to the first embodiment of the present invention.

The present disclosure will be described in more details with reference to the accompanying figures and embodiments. It should be noted that, under the condition of causing no conflicts, all embodiments and the features in all embodiments may be combined with each other.

First Embodiment

FIGS. 1-15 illustrate the compressor of the first embodiment of the present invention. The compressor is a two-staged enthalpy-increasing compressor, of which the medium-pressure chamber is disposed under the low-pressure chamber.

The compressor of the first embodiment mainly includes a case component, a motor, a low-pressure compression component, an enthalpy-increasing component, a lower flange 3, a high-pressure compression component, a pump baffle plate 11, an upper flange 14 and a liquid separator 1.

The case component includes an upper case 18*a*, an intermediate case 17 and a lower case 18*b*. The motor disposed inside the case component mainly includes a stator 15 and a rotor 16. The low-pressure compression component mainly includes a low-pressure cylinder 2 and a low-pressure roller 10 provided inside the low-pressure cylinder 2. There is a concave cavity at the lower part of the lower flange 3, and a lower cover plate 4 is provided on the concave cavity of the lower flange 3 to form the medium-pressure chamber. The high-pressure compression component mainly includes a high-pressure cylinder 12 and a high-pressure roller 13 provided in the high-pressure cylinder 12. The enthalpy-increasing component mainly includes an enthalpy-increasing sealing ring 5, a enthalpy-increasing pump suction pipe 6, an enthalpy-increasing case suction pipe 7 and an enthalpy-increasing bent pipe 8.

The liquid separator 1 is fixed on the intermediate case 17 through welding, and the low-pressure cylinder 2 is fixed on the lower flange 3 with bolts. The liquid separator 1 is connected to the low-pressure cylinder 2 through a suction pipe. The lower cover plate 4 is fixed on the lower part of the lower flange 3 with bolts. The enthalpy-increasing case suction pipe 7 is welded on the intermediate case 17. Through an interference fit with the enthalpy-increasing sealing ring 5, the enthalpy-increasing pump suction pipe 6 is pressed tightly on the inner wall of the enthalpy-increasing opening 23 of the low-pressure cylinder 2. The enthalpy-increasing bent pipe 8 is welded to connect to the enthalpy-increasing case suction pipe 7 and the enthalpy-increasing pump suction pipe 6. The high-pressure cylinder 12 is fixed on the upper flange 14 with bolts and is connected with the pump baffle plate 11. The upper flange 14 is welded on the intermediate case 17. A crankshaft 9 goes through the lower flange 3, the low-pressure cylinder 2, the lower cover plate 4, the pump baffle plate 11, the high-pressure cylinder 12 and the upper flange 14. The low-pressure roller 10 is sleeved on the lower eccentric part of the crankshaft 9, and the high-pressure roller 13 is sleeved on the upper eccentric part of the crankshaft 9. The compressor vent pipe 19 is welded on the upper case 18*a*. The upper case 18*a* is hermetically welded on the top of the intermediate case 17, and the lower case 18*b* is hermetically welded on the bottom of the intermediate case 17.

The circulation process of the refrigerant in the compressor of the first embodiment is briefly described as follows:

Driven by the motor, the low-pressure compression component and the high-pressure compression component run. The refluent low-pressure refrigerant from the air conditioner system flows into the low-pressure cylinder 2 through the liquid separator 1, and the refrigerant is compressed to form the first medium-pressure refrigerant. The first medium-pressure refrigerant, which is compressed by the low-pressure compression component, sequentially flows through the gas outlet 21 of the low-pressure cylinder 2 and the exhaust opening 31 of the lower flange 3 shown in FIGS. 13 and 14, and finally is discharged into the medium-pressure chamber formed by the lower flange 3 and the lower cover plate 4. At the same time, the second medium-pressure refrigerant sequentially flows through a medium-pressure loop of the air conditioner system, the enthalpy-increasing bent pipe 8, the enthalpy-increasing pump suction pipe 6, the enthalpy-increasing opening 23 of the low-pressure cylinder 2 shown in FIGS. 10 and 11, and finally flows into the medium-pressure chamber, being mixed with the first medium-pressure refrigerant to form the mixed medium-pressure refrigerant. The mixed medium-pressure refrigerant sequentially flows through the first medium-pressure gas passageway 32 provided in the upper flange 3, the second medium-pressure gas passageway 22 provided in the low-pressure cylinder 2 and the third medium-pressure gas passageway 111 provided in the pump baffle plate 11. The high-pressure cylinder 12 takes in the mixed medium-pressure refrigerant through the inlet port 121 of the high-pressure cylinder 12, then the mixed medium-pressure refrigerant is compressed by the high-pressure compression component to form the high-pressure refrigerant. The high-pressure refrigerant sequentially flows through the gas outlet 122 of the high-pressure cylinder 12 and the exhaust opening 141 of the upper flange 14, then the high-pressure refrigerant is discharged into the upper cavity enclosed by the upper flange 14, the intermediate case 17 and the upper case 18*a*, and further discharged into the evaporator or the condenser of the air conditioner system through the vent pipe 19. Thus, one process cycle of the two-staged compressing and enthalpy-increasing has been done. The directions of the arrowheads shown in FIG. 1 illustrate the flow directions of the refrigerant in the compressor.

As can be seen from the above, the low-pressure gas passageway includes the gas outlet 21 of the low-pressure cylinder 2 and the exhaust opening 31 of the lower flange.

The medium-pressure gas passageway is divided into three passageway sections: the passageway section disposed at the side toward the low-pressure chamber gas discharge passageway, namely, the first medium-pressure gas passageway 32 disposed in the lower flange 3; the intermediate passageway section, including the second medium-pressure gas passageway 22 disposed in the low-pressure cylinder 2 and the third medium-pressure gas passageway 111 disposed in the pump baffle plate 11; and the passageway section disposed at the side toward the high-pressure chamber gas suction passageway, namely, the beveled inlet port 121 disposed in the high-pressure cylinder 12.

The high-pressure chamber gas discharge passageway includes the passageway section between the gas outlet 122 of the high-pressure cylinder 12 and the exhaust opening 141 of the upper flange 14. Preferably, the ratio between the cross sectional area of the low-pressure chamber gas discharge passageway and the cross sectional area of the high-pressure chamber gas discharge passageway is 1.2.

In the first embodiment of the present invention, the pressure fluctuation and the flow velocity fluctuation of the refrigerant is reduced by means of setting proper ranges of the ratios between cross sectional areas of three different passageway sections of the medium-pressure gas passageway, thereby improving the energy efficiency ratio of the compressor and reducing the energy consumption.

Specifically, the ratios between the minimum cross sectional areas of three different passageway sections of the medium-pressure gas passageway are as follows: the ratio $H_2$ between the minimum cross sectional area of the passageway section at the side toward the low-pressure chamber gas discharge passageway and the minimum cross sectional area of the intermediate passageway section is ranged from 1.2 to 2. The ratio $H_3$ between the minimum cross sectional area of the intermediate passageway section and the minimum cross sectional area of the passageway section at the side toward the high-pressure chamber gas suction passageway is ranged from 1.2 to 2. Whereas, it is appropriate that the ratio H between the minimum cross sectional area of the passageway section at the side toward the low-pressure chamber gas discharge passageway and the minimum cross sectional area of the passageway section at the side toward the high-pressure chamber gas suction passageway is ranged from 1.4 to 4.

Figure 16:
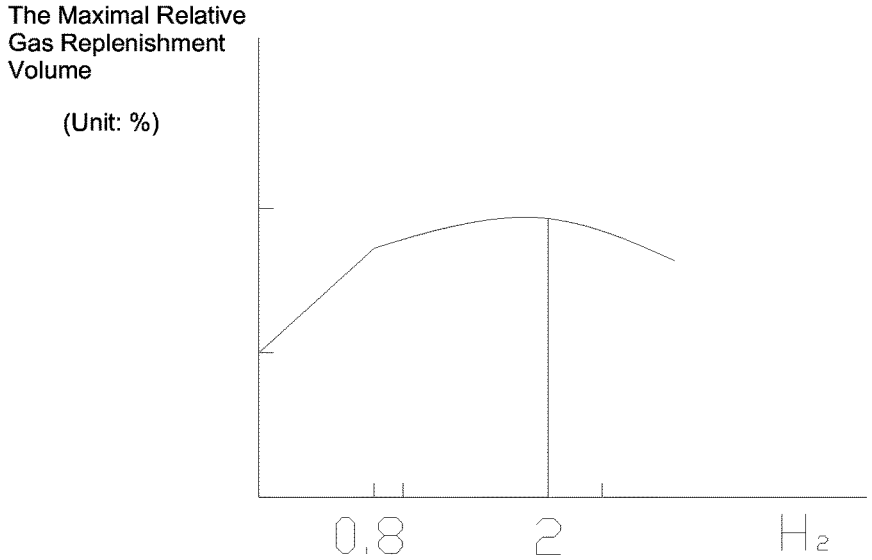
FIG. 16 is a schematic diagram illustrating the maximal relative gas replenishment volume varying with $H_2$ according to the compressor of the first embodiment of the present invention.
Figure 17:
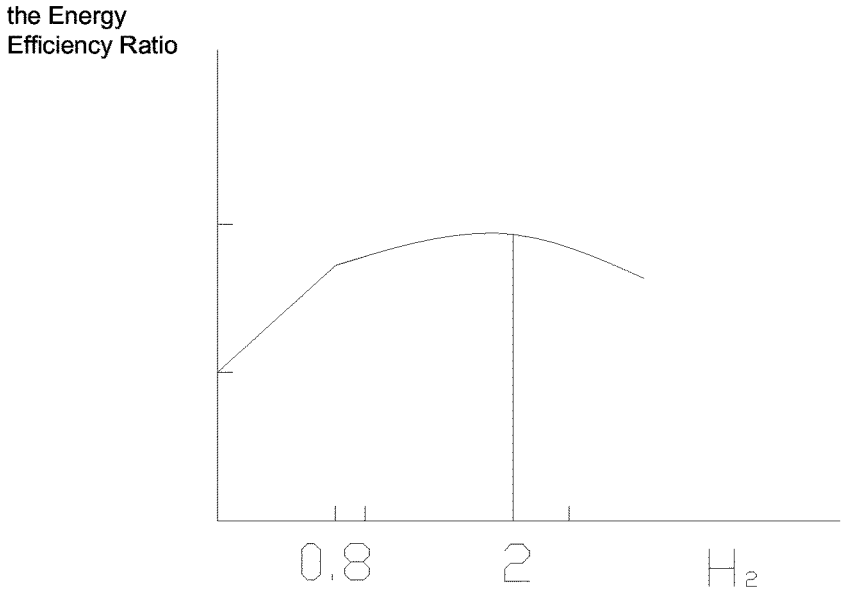
FIG. 17 is a schematic diagram illustrating the energy efficiency ratio varying with the area ratio $H_2$ according to the compressor of the first embodiment of the present invention.

As shown in FIG. 16, a schematic diagram illustrating the maximal relative gas replenishment volume varying with $H_2$, when $H_2$ is within the range from 1.2 to 2, the maximal relative gas replenishment volume is greater. As shown in FIG. 17, a schematic diagram illustrating the energy efficiency ratio varying with $H_2$, when $H_2$ is within the range from 1.2 to 2, the energy efficiency ratio is greater. The profiles of maximal relative gas replenishment volume and the energy efficiency ratio varying with $H_3$ are similar to those varying with $H_2$ shown in FIGS. 16 and 17. Also when $H_3$ is within the range from 1.2 to 2, the maximal relative gas replenishment volume and the energy efficiency ratio are optimal, which are not shown in the figures. In such cases, the pressure fluctuation and the flow velocity fluctuation of the refrigerant are relatively smaller, which improves the first-stage gas discharge plumpness and the second-stage gas suction plumpness, and increases the relative gas replenishment volume, thereby improving the energy efficiency ratio of the compressor and reducing the energy consumption.

Figure 18:
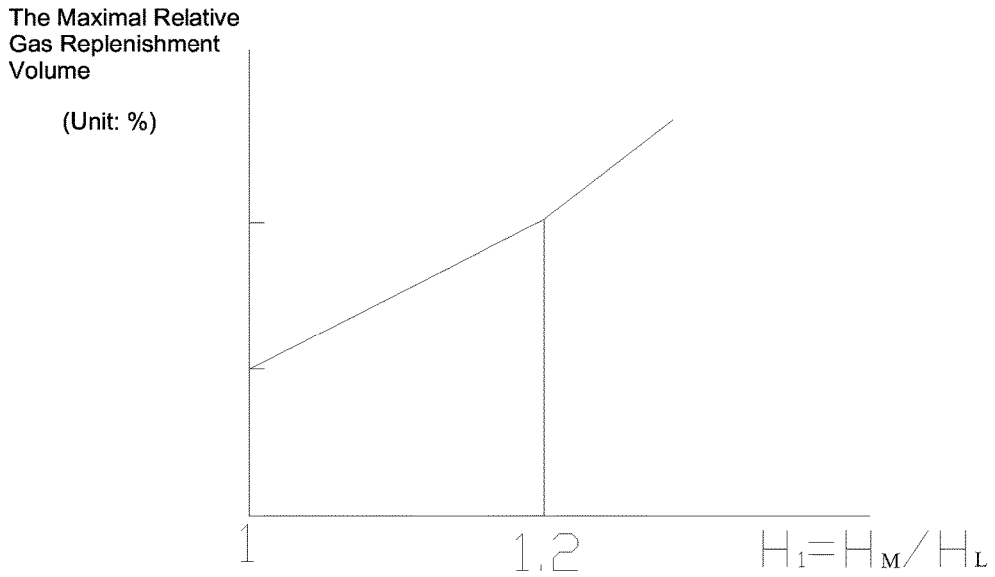
FIG. 18 is a schematic diagram illustrating the maximal relative gas replenishment volume varying with the ratio $H_1$ according to the compressor of the first embodiment of the present invention.
Figure 19:
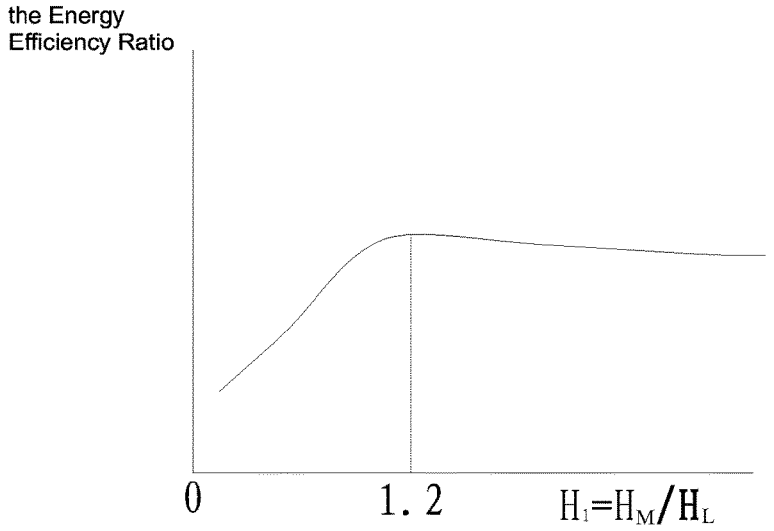
FIG. 19 is a schematic diagram illustrating the energy efficiency ratio varying with the ratio $H_1$ according to the compressor of the first embodiment of the present invention.

Preferably, in the first embodiment, the ratio $H_1$ between the minimum cross sectional area $H_M$ of the medium-pressure gas passageway and the minimum cross sectional area $H_L$ of the low-pressure chamber gas discharge passageway is greater than 1.2. As shown in FIG. 18, a schematic diagram illustrating the maximal relative gas replenishment volume varying with the ratio $H_1$, the maximal relative gas replenishment volume increases with the increasing $H_1$, when $H_1$ is greater than 1.2, the maximal relative gas replenishment volume increases with the increasing $H_1$ more remarkably. As shown in FIG. 19, a schematic diagram illustrating the energy efficiency ratio varying with the ratio $H_1$, the energy efficiency ratio firstly increases with the increasing $H_1$ then decreases, when $H_1$ is greater than 1.2, the energy efficiency ratio approaches the maximum.

Figure 20:
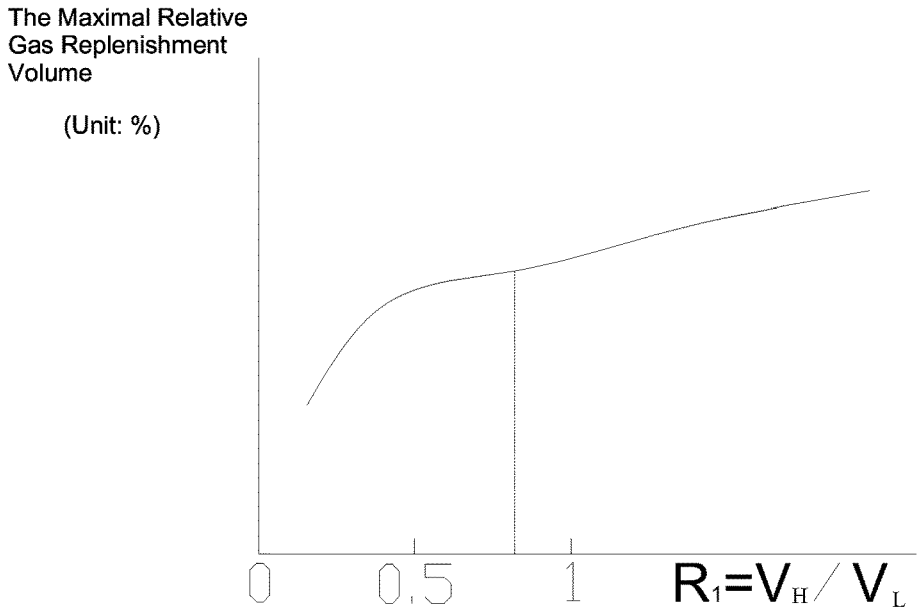
FIG. 20 is a schematic diagram illustrating the maximal relative gas replenishment volume varying with the ratio $R_1$ according to the compressor of the first embodiment of the present invention.
Figure 21:
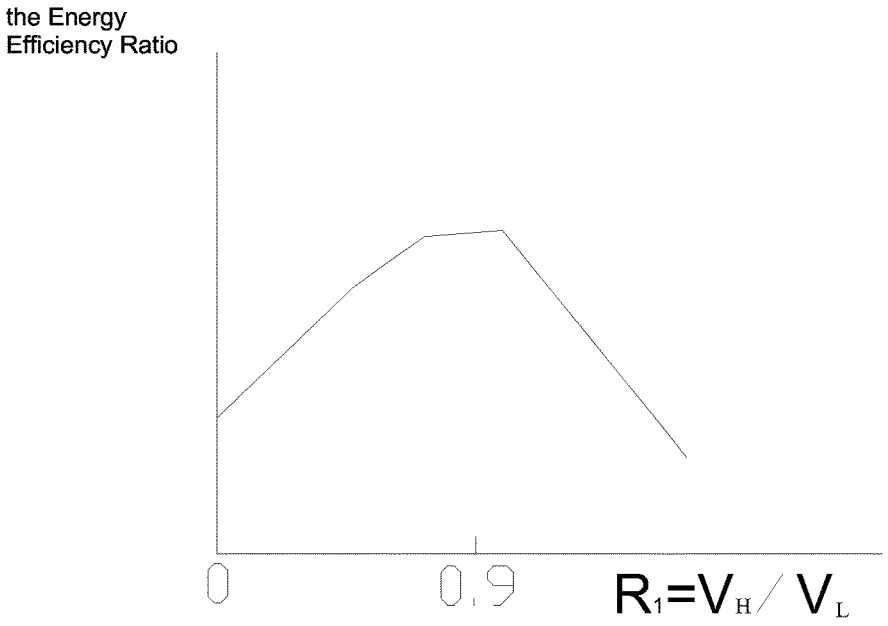
FIG. 21 is a schematic diagram illustrating the energy efficiency ratio varying with the ratio $R_1$ according to the compressor of the first embodiment of the present invention.

Preferably, in the first embodiment, the ratio $R_1$ between the volume $V_H$ of the high-pressure chamber and the volume $V_L$ of the low-pressure chamber is ranged from 0.8 to 0.9. As shown in FIG. 20, a schematic diagram illustrating the maximal relative gas replenishment volume varying with the ratio $R_1$, the maximal relative gas replenishment volume increase with the increasing $R_1$, when $R_1$ is within the range from 0.8 to 0.9, the maximal relative gas replenishment volume starts to increase more remarkably. As shown in FIG. 21, a schematic diagram illustrating the energy efficiency ratio varying with the ratio $R_1$, the energy efficiency ratio firstly increases with the increasing $R_1$ then decreases, when $R_1$ is within the range from 0.8 to 0.9, the energy efficiency ratio approaches the maximum.

Various methods may be implemented to make the ratio $R_1$ be ranged from 0.8 to 0.9. For example, following methods can be implemented:

When the eccentricity amount of the upper eccentric part of the crankshaft 9 inserted in the high-pressure cylinder 12 is equal to the eccentricity amount of the lower eccentric part of the crankshaft 9 inserted in the low-pressure cylinder 2, the volume ratio $R_1$ ranged from 0.8 to 0.9 is achieved by regulating the ratio between the height of the high-pressure cylinder 12 and the height of the low-pressure cylinder 2, specifically, by regulating the height of the high-pressure cylinder 12 to be less than the height of the low-pressure cylinder 2.

When the height of the high-pressure cylinder 12 equals to the height of the low-pressure cylinder 2, the volume ratio $R_1$ ranged from 0.8 to 0.9 is achieved by regulating the ratio between the eccentricity amount of the upper eccentric part of the crankshaft 9 inserted in the high-pressure cylinder 12 and the eccentricity amount of the lower eccentric part of the crankshaft 9 inserted in the low-pressure cylinder 2, specifically, by regulating the eccentricity amount of the lower eccentric part to be less than the eccentricity amount of the upper eccentric part.

Under the condition that the ratio between the height and the inner diameter of the high-pressure cylinder 12 and the ratio between the height and the inner diameter of the low-pressure cylinder 2 are both ranged from 0.4 to 0.55, and that the ratio between the eccentricity amount of the upper eccentric part of the crankshaft and the inner diameter of the high-pressure cylinder is ranged from 0.1 to 0.2, and that the ratio between the eccentricity amount of the lower eccentric part of the crankshaft and the inner diameter of the low-pressure cylinder is also ranged from 0.1 to 0.2, the volume ratio $R_1$ ranged from 0.8 to 0.9 is achieved by simultaneously regulating the height and inner diameter of the high-pressure cylinder 12 and the height and inner diameter of the low-pressure cylinder 2, and by regulating the eccentricity amount of the upper eccentric part of the crankshaft 9 and the eccentricity amount of the lower eccentric part of the crankshaft 9.

Figure 22:
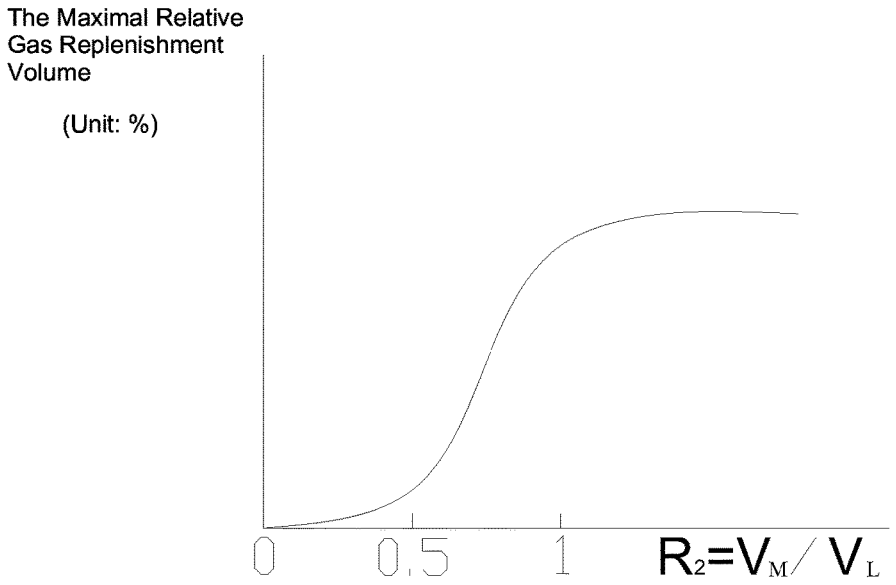
FIG. 22 is a schematic diagram illustrating the maximal relative gas replenishment volume varying with the ratio $R_2$ according to the compressor of the first embodiment of the present invention.
Figure 23:
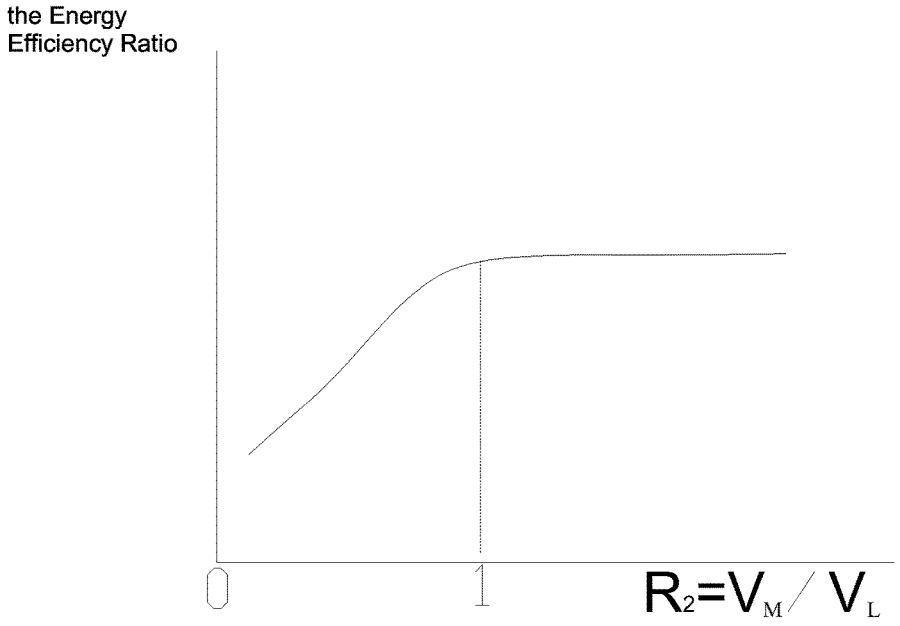
FIG. 23 is a schematic diagram illustrating the energy efficiency ratio varying with the ratio $R_2$ according to the compressor of the first embodiment of the present invention.

Preferably, in the first embodiment, the ratio $R_2$ between the volume $V_M$ of the medium-pressure chamber and the volume $V_L$ of the low-pressure chamber is greater than 1. In such cases, the flow fluctuation of the replenishment gas is relatively smaller, and the maximal relative gas replenishment volume and the energy efficiency ratio are relatively larger. As shown in FIG. 22, a schematic diagram illustrating the maximal relative gas replenishment volume varying with $R_2$, the maximal relative gas replenishment volume increases with the increasing $R_2$, when $R_2$ equals to 1, the maximal relative gas replenishment volume approaches to a relatively greater value, and when $R_2$ is greater than 1, the maximal relative gas replenishment volume is greater. As shown in FIG. 23, a schematic diagram illustrating the energy efficiency ratio varying with the ratio $R_2$, the energy efficiency ratio increases with the increasing $R_2$, when $R_2$ is greater than 1, the energy efficiency ratio approaches the maximum.

The other two embodiments of the present invention will be described as follows. The same or similar structures, or same or similar parameter ranges as those described in the first embodiment of the compressor will not be described in details here.

Second Embodiment

Figure 24:
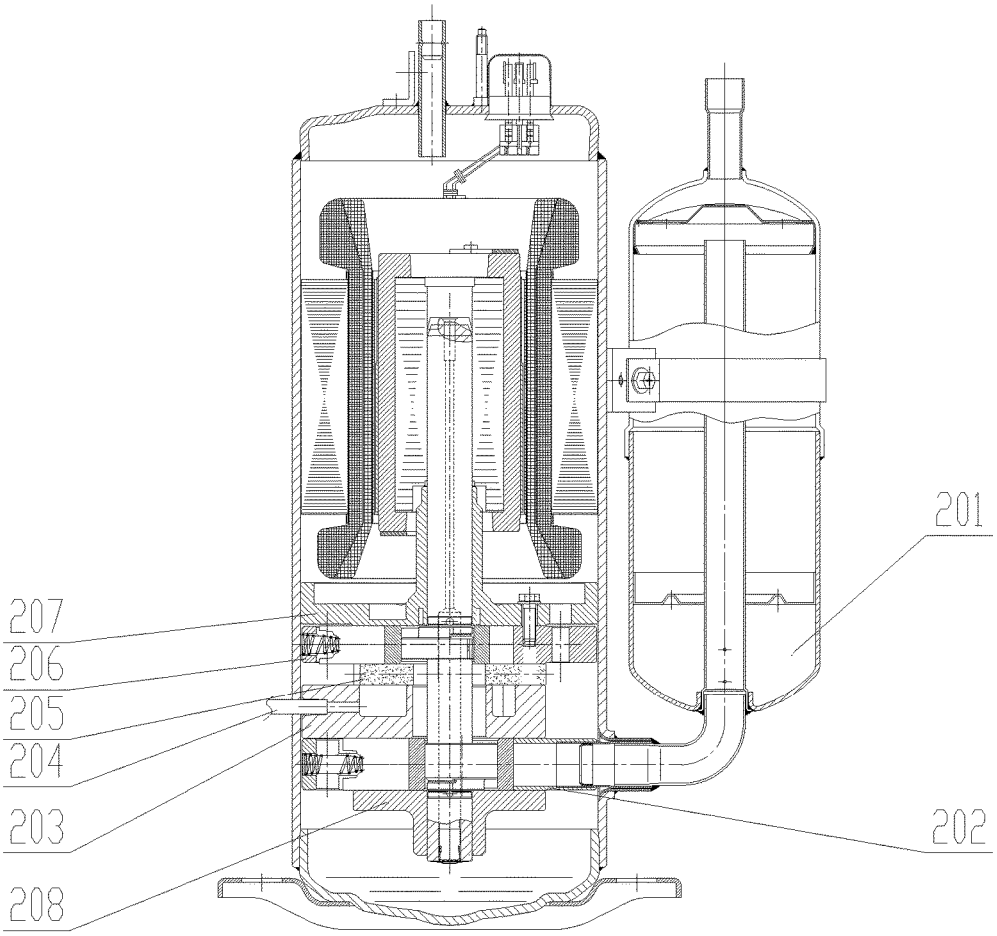
FIG. 24 is a schematic view illustrating the structure of the compressor according to the second embodiment of the present invention.

As shown in FIG. 24, the second embodiment of the compressor is a two-staged enthalpy-increasing compressor, of which the medium-pressure chamber is disposed between the low-pressure compression component and the high-pressure compression component. The compressor mainly includes a liquid separator 201, a low-pressure cylinder 202, an intermediate cylinder 203, an enthalpy-increasing pipe 204, a pump baffle plate 205, a high-pressure cylinder 206, an upper flange 207, a lower flange 208 and so on. In the second embodiment of the compressor, as the medium-pressure chamber is provided above the low-pressure chamber, the medium-pressure refrigerant in the whole compressor flows directly into the high-pressure compression component.

In the second embodiment, the liquid separator 201 is connected to the low-pressure cylinder 202 through a suction pipe. The low-pressure cylinder 202 is fixed on the lower flange 208 with bolts. The intermediate cylinder 203 is fixed on the low-pressure cylinder 202 with bolts. There is a concave cavity in the upper part of the intermediate cylinder 203. The pump baffle plate 205 is provided on the concave cavity of the intermediate cylinder 203 to form a medium-pressure chamber. The enthalpy-increasing pipe 204 is communicated to the medium-pressure chamber in the intermediate cylinder 203. The pump baffle plate 205 is fixed on the intermediate cylinder 203 with bolts. The high-pressure cylinder 206 is fixed on the upper flange 207 with bolts, and is connected with the pump baffle plate 205. The upper flange 207 is welded on the case component.

The refluent low-pressure refrigerant from the air conditioner system flows into the suction port of the low-pressure cylinder 202 through the liquid separator 201, and the refrigerant is compressed by the low-pressure compression component to form the first medium-pressure refrigerant. The first medium-pressure refrigerant flows through the gas outlet of the low-pressure cylinder 202 and the gas outlet of the intermediate cylinder 203, and then flows into the medium-pressure chamber formed by the intermediate cylinder 203 and the pump baffle plate 205. The second medium-pressure refrigerant for replenishing gas and increasing enthalpy sequentially flows through the enthalpy-increasing pipe 204 and the suction port of the intermediate cylinder 203, and finally flows into the intermediate cylinder 203, being mixed with the first medium-pressure refrigerant in the medium-pressure chamber to form the mixed medium-pressure refrigerant. The mixed medium-pressure refrigerant flows into the suction port of the high-pressure cylinder 206 through the medium-pressure gas passageway of the pump baffle plate 205. After the mixed medium-pressure refrigerant is compressed by the high-pressure compression component to form the high-pressure refrigerant, the high-pressure refrigerant sequentially flows through the gas outlet of the high-pressure cylinder 206 and the exhaust opening of the upper flange 207. Then the high-pressure refrigerant is discharged into the upper cavity enclosed by the case component and the upper flange 207. Finally, the refrigerant flows into the air conditioner system through the vent pipe of the compressor, and then flows into the compressor after being vaporized by the air conditioner system. Thus, one circulation cycle of the refrigerant is done.

As can be seen from the above, in the second embodiment, the low-pressure gas passageway includes the gas outlet of the low-pressure cylinder 202 and the gas outlet of the intermediate cylinder 203.

In the second embodiment, the medium-pressure gas passageway is divided into two passageway sections: the medium-pressure gas passageway provided in the pump baffle plate 205, which is disposed at the side toward the low-pressure chamber gas discharge passageway; and the suction port of the high-pressure cylinder 206, which is disposed at the side toward the high-pressure chamber gas suction passageway.

While the high-pressure chamber gas discharge passageway includes the gas outlet of the high-pressure cylinder 206 and the exhaust opening of the upper flange 207.

Comparing with the first embodiment of the compressor, the intermediate passageway section is not provided in the second embodiment of the compressor. It is verified by experiments that, in the second embodiment, it is also appropriate that the ratio H between the minimum cross sectional area of the passageway section at the side toward the low-pressure chamber gas discharge passageway and the minimum cross sectional area of the passageway section at the side toward the high-pressure chamber gas suction passageway is ranged from 1.4 to 4. The ranges of other parameters such as $H_1$, $R_1$, $R_2$, and the range of the ratio between the cross sectional area of the low-pressure chamber gas discharge passageway and the cross sectional area of the high-pressure chamber gas discharge passageway, as well as the effects achieved in the second embodiment of the compressor, are all close to those in the first embodiment of the compressor; all methods for achieving the volume ratio R1 in the first embodiment of the compressor are also applicable to the second embodiment of the compressor, thus they will not be described repeatedly.

Third Embodiment

Figure 25:
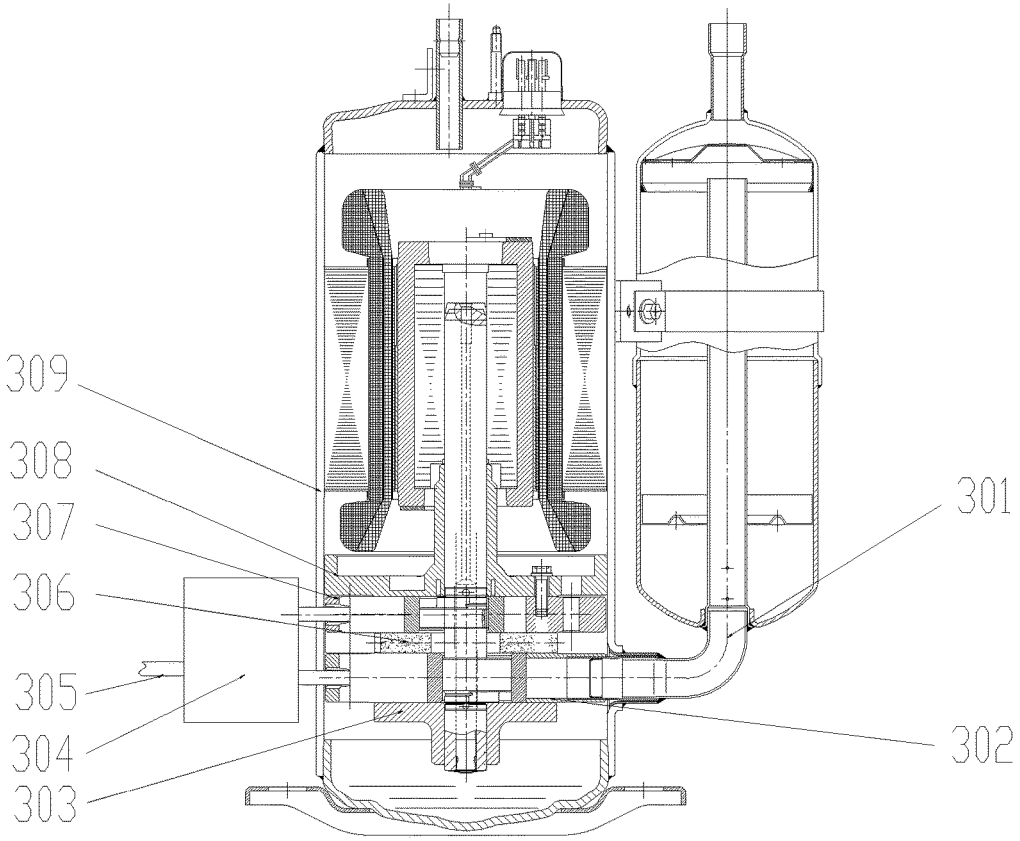
FIG. 25 is a schematic view illustrating the structure of the compressor according to the third embodiment of the present invention.

As shown in FIG. 25, the third embodiment of the compressor is a two-staged enthalpy-increasing compressor with an external medium-pressure chamber, which is constructed by an external pressure-tight intermediate box. The third embodiment of the compressor mainly includes a motor, a low-pressure compression component, an intermediate box 304, a high-pressure compression component, a case component, a liquid separator 301 and so on.

The liquid separator 301 is connected to the low-pressure cylinder 302 through a suction pipe. The low-pressure cylinder 302 is fixed on the lower flange 303 with bolts. The intermediate box 304 is fixed on the case component 309 through welding. The intermediate box 304 is communicated to the gas outlet provided in the low-pressure cylinder 302 through the first vent pipe, and is communicated to the suction port provided in the high-pressure cylinder 307 through the second vent pipe. The enthalpy-increasing pipe 305 is connected with the intermediate box 304. The pump baffle plate 306 is disposed at the upper side of the high-pressure cylinder 302. The high-pressure cylinder 307 is fixed on the upper flange 308 with bolts, and is connected with the pump baffle plate 306. The upper flange 308 is welded on the case component 309.

The refluent low-pressure refrigerant from the air conditioner system flows into the suction port of the low-pressure cylinder 302 through the liquid separator 301, and the refrigerant is compressed by the low-pressure compression component to form the first medium-pressure refrigerant. The first medium-pressure refrigerant sequentially flows through the gas outlet of the low-pressure cylinder 302 and the first vent pipe, and then flows into the medium-pressure chamber inside the intermediate box 304. The second medium-pressure refrigerant for replenishing gas and increasing enthalpy flows into the medium-pressure chamber inside the intermediate box 304 through the enthalpy-increasing pipe 305, being mixed with the first medium-pressure refrigerant in the medium-pressure chamber to form the mixed medium-pressure refrigerant. The mixed medium-pressure refrigerant flows into the suction port of the high-pressure cylinder 307 through the second vent pipe. The mixed medium-pressure refrigerant is compressed by the high-pressure compression component to form the high-pressure refrigerant. The high-pressure refrigerant sequentially flows through the gas outlet of the high-pressure cylinder 307 and the exhaust opening of the upper flange 308. Then the high-pressure refrigerant is discharged into the upper cavity enclosed by the case component 309 and the upper flange 308. Finally, the refrigerant flows into the air conditioner system through the gas discharge pipe of the compressor, and then flows into the compressor after being vaporized by the air conditioner system. Thus, one circulation cycle of the refrigerant is done.

As can be seen from the above, the low-pressure chamber gas discharge passageway in the third embodiment includes the gas outlet of the low-pressure cylinder 302.

In the third embodiment, the medium-pressure gas passageway is divided into three passageway sections: the passageway section disposed at the side toward the low-pressure chamber gas discharge passageway, namely, the first vent pipe; the intermediate passageway section, namely, the second vent pipe; and the passageway section disposed at the side toward the high-pressure chamber gas suction passageway, namely, the beveled inlet port disposed in the high-pressure cylinder 307.

While the high-pressure chamber gas discharge passageway includes the gas outlet of the high-pressure cylinder 307 and the exhaust opening of the upper flange component 308.

The ranges of the compressor parameters in the third embodiment such as H, $H_1$, $H_2$, $H_3$, $R_1$, $R_2$, and the range of the ratio between the cross sectional area of the low-pressure chamber gas discharge passageway and the cross sectional area of the high-pressure chamber gas discharge passageway, as well as the effects achieved in the third embodiment of the compressor, are all close to those in the first embodiment of the compressor; all methods for achieving the volume ratio R1 in the first embodiment of the compressor are also applicable to the third embodiment of the compressor, thus they will not be described repeatedly.

As can be seen from the above, all embodiments of the present invention can achieve the effects as follows: because of the reasonable design of the medium-pressure gas passageway and the optimal design for the range of the ratio H between the minimum cross sectional area of the passageway section at the side toward the low-pressure chamber gas discharge passageway and the minimum cross sectional area of the passageway section at the side toward the high-pressure chamber gas suction passageway, the pressure fluctuation and the flow velocity fluctuation of the refrigerant are relatively smaller, which can improve the first-stage gas discharge plumpness and the second-stage gas suction plumpness, and increase the gas replenishment volume, and accordingly, can improve the energy efficiency ratio of the compressor and reduce the energy consumption.

The preferred embodiments described above are not restrictive. It will be understood by those skilled in the art that various replacements and variations based on the thoughts of the present disclosure may be made. All modifications, equivalents, improvements and so on made within the spirit and principle of the present disclosure should be contained within the scope of the present disclosure.

What is claimed is:

1. A compressor, comprising:

a low-pressure compression component having a low-pressure chamber, configured to take in refrigerant and compress the refrigerant to form first medium-pressure refrigerant;

a medium-pressure chamber;

a low-pressure chamber gas discharge passageway, through which the first medium-pressure refrigerant from said low-pressure compression component is discharged into the medium-pressure chamber;

an enthalpy-increasing component, configured to convey second medium-pressure refrigerant into the medium-pressure chamber, the second medium-pressure refrigerant and the first medium-pressure refrigerant being mixed to form mixed medium-pressure refrigerant in the medium-pressure chamber;

a high-pressure compression component including a high-pressure chamber, configured to take in the mixed medium-pressure refrigerant and compress the mixed medium-pressure refrigerant to form high-pressure refrigerant;

a medium-pressure gas passageway, through which the mixed medium-pressure refrigerant from the medium-pressure chamber is conveyed into the high-pressure compression component;

a high-pressure chamber gas discharge passageway, through which the high-pressure refrigerant is discharged from the high-pressure compression component;

wherein, the medium-pressure gas passageway comprises a passageway section at a side toward the low-pressure chamber gas discharge passageway, and a passageway section at a side toward the high-pressure chamber gas suction passageway, wherein, a ratio between a minimum cross sectional area of the passageway section at the side toward the low-pressure chamber gas discharge passageway and a minimum cross sectional area of the passageway section at the side toward the high-pressure chamber gas suction passageway is ranged from 1.4 to 4.

2. The compressor according to claim 1, wherein, the medium-pressure gas passageway further comprises an intermediate passageway section, which is disposed between the passageway section at the side toward the low-pressure chamber gas discharge passageway and the passageway section at the side toward the high-pressure chamber gas suction passageway; wherein, a ratio $H_2$ between the minimum cross sectional area of the passageway section at the side toward the low-pressure chamber gas discharge passageway and a minimum cross sectional area of the intermediate passageway section is ranged from 1.2 to 2; a ratio $H_3$ between the minimum cross sectional area of the intermediate passageway section and the minimum cross sectional area of the passageway section at the side toward the high-pressure chamber gas suction passageway is ranged from 1.2 to 2.

3. The compressor according to claim 1, wherein, a ratio between a cross sectional area of the low-pressure chamber gas discharge passageway and a cross sectional area of the high-pressure chamber gas discharge passageway is 1.2.

4. The compressor according to claim 1, wherein, a ratio $H_1$ between a minimum cross sectional area $H_M$ of the medium-pressure gas passageway and a minimum cross sectional area $H_L$ of the low-pressure chamber gas discharge passageway is greater than 1.2.

5. The compressor according to claim 1, wherein, a volume ratio $R_1$ between a volume $V_H$ of the high-pressure chamber and a volume $V_L$ of the low-pressure chamber is ranged from 0.8 to 0.9.

6. The compressor according to claim 5, wherein:

the compressor further comprises a crankshaft (9); the crankshaft (9) comprises a first eccentric part and a second eccentric part;

the low-pressure compression component comprises a low-pressure cylinder (2), and a low-pressure roller (10) which is disposed on the first eccentric part inside the low-pressure cylinder (2); the low-pressure chamber is formed between the low-pressure cylinder (2) and the low-pressure roller (10);

the high-pressure compression component comprises a high-pressure cylinder (12), and a high-pressure roller (13) which is disposed on the second eccentric part inside the high-pressure cylinder (12); and the high-pressure chamber is formed between the high-pressure cylinder (12) and the high-pressure roller (13).

7. The compressor according to claim 6, wherein:

an eccentricity amount of the first eccentric part is equal to an eccentricity amount of the second eccentric part; and a height of the high-pressure cylinder (12) is less than a height of the low-pressure cylinder (2).

8. The compressor according to claim 6, wherein:

an eccentricity amount of the first eccentric part is less than an eccentricity amount of the second eccentric part; and a height of the high-pressure cylinder (12) is equal to a height of the low-pressure cylinder (2).

9. The compressor according to claim 6, wherein:

a ratio between a height and an inner diameter of the low-pressure cylinder (2) is ranged from 0.4 to 0.55;

a ratio between a height and an inner diameter of the high-pressure cylinder (12) is ranged from 0.4 to 0.55;

a ratio between the eccentricity amount of the first eccentric part and the inner diameter of the low-pressure cylinder (2) is ranged from 0.1 to 0.2; and a ratio between the eccentricity amount of the second eccentric part and the inner diameter of the high-pressure cylinder (12) is ranged from 0.1 to 0.2.

10. The compressor according to claim 1, wherein, a volume ratio $R_2$ between a volume $V_M$ of the medium-pressure chamber and a volume $V_L$ of the low-pressure chamber is greater than 1.

11. The compressor according to claim 1, wherein, the compressor further comprises:

a lower flange (3), which is provided under the low-pressure compression component, and said lower flange (3) is provided with a concave cavity;

a lower cover plate (4), which is provided under the lower flange (3), and said lower cover plate (4) covers on the concave cavity of the lower flange (3) so that the medium-pressure chamber is formed by the lower flange (3) and the lower cover plate (4).

12. An air conditioner system, comprising a compressor, wherein, the compressor is the compressor according to claim 1.

13. A heat pump water heater system, comprising a compressor, wherein, the compressor is the compressor according to claim 1.

14. The compressor according to claim 2, wherein, a ratio between a cross sectional area of the low-pressure chamber gas discharge passageway and a cross sectional area of the high-pressure chamber gas discharge passageway is 1.2.

15. The compressor according to claim 2, wherein, a ratio $H_1$ between a minimum cross sectional area $H_M$ of the medium-pressure gas passageway and a minimum cross sectional area $H_L$ of the low-pressure chamber gas discharge passageway is greater than 1.2.

16. The compressor according to claim 2, wherein, a volume ratio $R_1$ between a volume $V_H$ of the high-pressure chamber and a volume $V_L$ of the low-pressure chamber is ranged from 0.8 to 0.9.

17. The compressor according to claim 2, wherein, a volume ratio $R_2$ between a volume $V_M$ of the medium-pressure chamber and a volume $V_L$ of the low-pressure chamber is greater than 1.

18. The compressor according to claim 2, wherein, the compressor further comprises:

a lower flange (3), which is provided under the low-pressure compression component, and said lower flange (3) is provided with a concave cavity;

a lower cover plate (4), which is provided under the lower flange (3), and said lower cover plate (4) covers on the concave cavity of the lower flange (3) so that the medium-pressure chamber is formed by the lower flange (3) and the lower cover plate (4).

* * * * *